US009890571B1

(12) United States Patent
Marsden

(10) Patent No.: US 9,890,571 B1
(45) Date of Patent: Feb. 13, 2018

(54) WINDOW LOCK

(71) Applicant: Elbee Pty Ltd., Bondi Junction (AU)

(72) Inventor: Andrew Marsden, Hingham, MA (US)

(73) Assignee: Elbee Pty Ltd., Bondi Junction (AU)

( * ) Notice: Subject to any disclaimer, the term of this patent is extended or adjusted under 35 U.S.C. 154(b) by 0 days.

(21) Appl. No.: 15/452,667

(22) Filed: Mar. 7, 2017

(51) Int. Cl.
*E05B 65/06* (2006.01)
*E05C 17/36* (2006.01)
*E05C 17/08* (2006.01)
*E05C 17/46* (2006.01)

(52) U.S. Cl.
CPC ..... *E05C 17/36* (2013.01); *E05C 17/08* (2013.01); *E05C 17/46* (2013.01)

(58) Field of Classification Search
CPC ..... E05C 17/36; E05C 17/46; E05C 17/08; E05C 17/365
USPC .... 70/23, 24, 26, 32–34, 39, 49, 89, 90, 93, 70/181, 380, DIG. 12; 292/262–264, 278, 292/DIG. 20, DIG. 33, DIG. 35, DIG. 46, 292/DIG. 47
See application file for complete search history.

(56) References Cited

U.S. PATENT DOCUMENTS 795,882 A * 8/1905 Atkin ..... E05C 17/365 292/264
2,970,465 A * 2/1961 Falk, Jr. ..... E05C 17/365 292/264
2,981,090 A * 4/1961 Patriquin ..... E05C 17/365 292/264
3,101,603 A * 8/1963 North ..... E05C 17/365 292/264
3,125,875 A * 3/1964 Friedman ..... E05C 17/365 292/264
3,631,896 A * 1/1972 Meigs ..... B60R 25/042 138/89
3,640,106 A * 2/1972 Lorincz ..... E05C 17/365 292/264
4,105,231 A * 8/1978 Huyssen ..... E05C 17/365 292/264
4,472,143 A 9/1984 Bennett et al.
4,832,386 A * 5/1989 Sweet ..... E05B 15/0205 292/264
5,285,666 A * 2/1994 Bartnicki ..... E05C 17/365 292/264
5,768,920 A * 6/1998 DeBevoise ..... E05B 73/0005 70/18

(Continued)

FOREIGN PATENT DOCUMENTS

GB 2527920 * 1/2016
WO WO 2014/108680 A1 7/2014
WO WO 2017/035567 A1 3/2017

*Primary Examiner* — Lloyd A Gall
(74) *Attorney, Agent, or Firm* — Wolf, Greenfield & Sacks, P.C.

(57) ABSTRACT

A window lock system selectively prevents a window from being opened. A window sash can be connected by a cord to the sill of the window. The cord has an attached lock insert. To lock the window, the insert on the cord is inserted into a track housed in a mount that is mounted to the sash or sill. The track may be formed as part of a rotatable disk. A key turns the track to move the track to a locked configuration. In the locked configuration, the sash and sill are connected by the cord. To unlock the window, the key rotates the disk to allow release of the insert from the track.

18 Claims, 5 Drawing Sheets

(56) References Cited

U.S. PATENT DOCUMENTS

| | | | | |
|---|---|---|---|---|
| 6,026,664 | A * | 2/2000 | Lin | E05B 67/003 70/18 |
| 6,419,258 | B1 * | 7/2002 | Grote | B60D 1/06 280/507 |
| 6,425,272 | B1 * | 7/2002 | Chen | E05B 67/36 70/20 |
| 8,763,433 | B2 * | 7/2014 | Mahaney | F16K 35/06 70/14 |
| 2002/0108407 | A1 * | 8/2002 | Zapushek | B60D 1/60 70/34 |
| 2005/0061039 | A1 * | 3/2005 | Hsieh | E05B 67/003 70/38 A |
| 2007/0180871 | A1 * | 8/2007 | Irgens | E05B 67/36 70/34 |
| 2011/0173895 | A1 | 7/2011 | Lund et al. | |
| 2016/0123041 | A1 * | 5/2016 | Chen | B60D 1/60 70/34 |

* cited by examiner

WINDOW LOCK

FIELD

The disclosed embodiments relate generally to window locks, and more particularly to window locks with cords.

DISCUSSION OF THE RELATED ART

Window locks help prevent windows from being opened to improve home and child safety. In some municipalities, for safety purposes, window locks are required to be operable only with removable keys if the window is above a certain height. Window locks may be built into the window, or window locks may be attached to windows.

SUMMARY

According to one embodiment, a window lock comprises a first mount configured to be attached to a first window component, a flexible cord attached to the first mount, and a second mount configured to be attached to a second window component. One of the first and second window components is movable relative to the other. The second mount includes a rotating lock disk, with the disk having a key receptor and a track. A lock insert is attached to the flexible cord, and a key is configured to engage with the key receptor such that rotation of the key rotates the rotating lock disk. The lock insert is insertable into the track when the disk is at a first rotation state, and the disk has a second rotation state at which removal of the insert from the second mount is prevented.

According to another embodiment, a method of operating a window lock is provided. The window lock includes a first mount attached to a first window component, a flexible cord attached to the first mount, a second mount attached to a second window component that is movable relative to the first window component. The lock insert is attached to the flexible cord. The method includes inserting the lock insert into a track of a rotating lock disk with the rotating disk being in a first rotation state, the rotating lock disk being attached to the second mount. The method also includes inserting a key into a key receptor of the second mount, and turning the key turn the rotating lock disk from the first rotation state to a second rotation state such that the track of rotated lock disk prevents the lock insert from being removed from the second mount. Also included is removing the key from the key receptor.

According to a further embodiment, a window lock includes a first mount configured to be attached to a first window component, and a flexible cord attached to the first mount. The lock further includes a second mount configured to be attached to a second window component, with one of the first and second window components being movable relative to the other. The second mount including a rotating lock disk. A lock insert is attached to the flexible cord. The lock further includes a disk actuator which rotates the rotating lock disk from a first rotation state to a second rotation state. The lock insert is insertable into the track when the disk is at the first rotation state, and when the disk is at the second rotation state, removal of the insert from the second mount is prevented by the track.

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. Various embodiments of the invention will now be described, by way of example, with reference to the accompanying drawings, in which.

DETAILED DESCRIPTION

Figure 1:
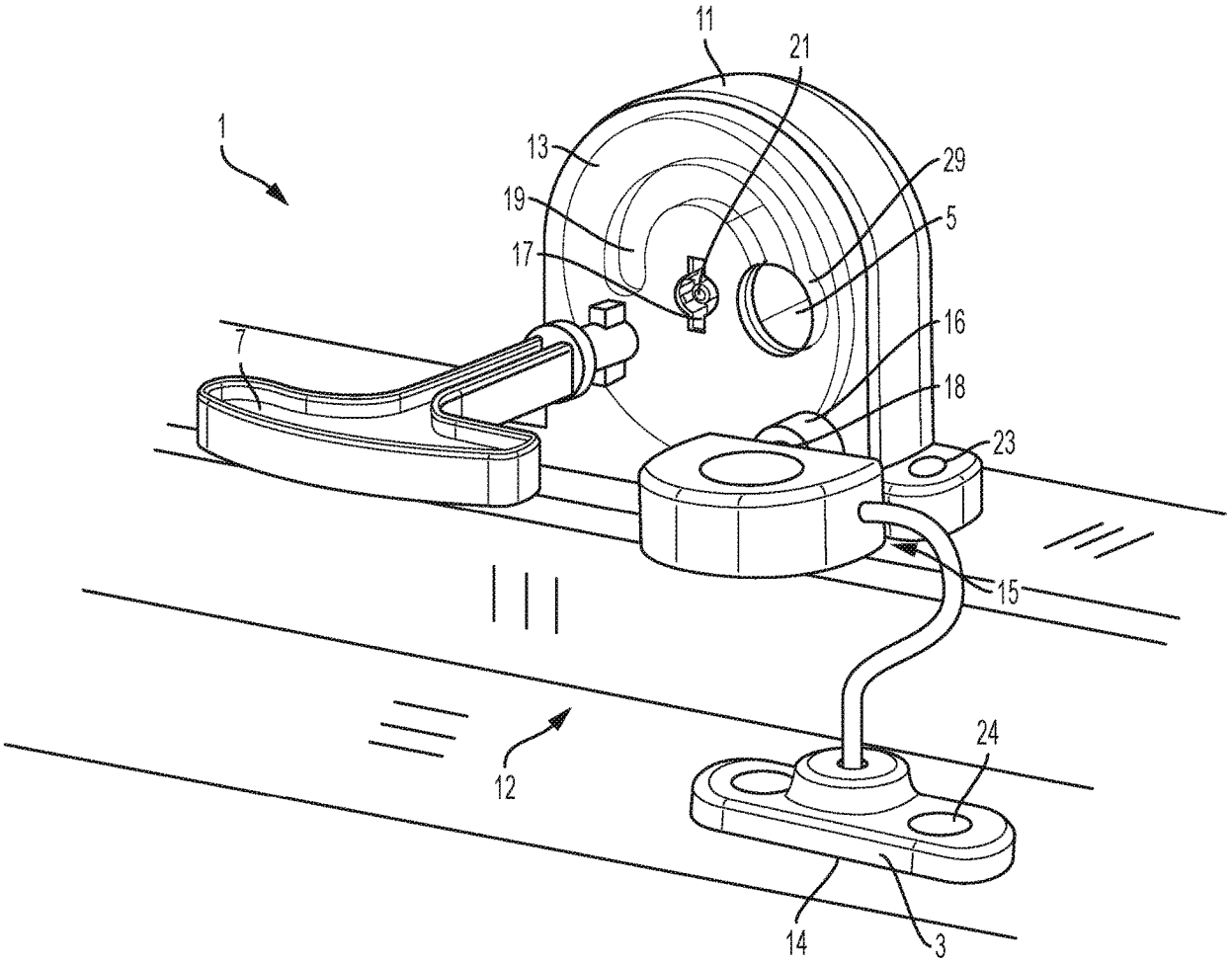
FIG. 1 is a right side, front perspective view of a window lock according to one embodiment.

It should be understood that aspects of the invention are described herein with reference to certain illustrative embodiments and the figures. The illustrative embodiments described herein are not necessarily intended to show all aspects of the invention, but rather are used to describe a few illustrative embodiments. Thus, aspects of the invention are not intended to be construed narrowly in view of the illustrative embodiments. In addition, it should be understood that aspects of the invention may be used alone or in any suitable combination with other aspects of the invention.

Window locks are used to help prevent windows from being accidentally opened. For example, falling through an open window in a tall building could be fatal or result in serious injury. Some window locks include a cord that removably connects two mounts—one mount being attached to the sill and the other attached to the frame. By connecting the cord to both mounts, the lock helps prevent the window from being opened by a substantial amount. To permit opening of the window, the attachment of the cord is selectively removable from one of the mounts via an insert such as a headed pin. The insert is placed into the mount and secured thereto. In some window locks, the insert is slid along a channel, and a blocker is moved into place to prevent the insert from being slid out of the channel.

Applicant has recognized that a window lock with a rotational lock has certain advantages compared to a linear lock. Because a rotational lock may have a curved locking path, a rotational lock may have a longer locking path than a linear lock when both locks are provided with a same maximum dimension. Additionally, Applicant has recognized that the motion of engaging a longer locking path and/or a rotational path may provide natural feedback to a user that the lock has been secured.

One embodiment of a window lock of the present disclosure includes a first mount on a movable window portion and a second mount on a stationary window portion. Both the first mount and second mount may be fixed to their respective window portions with screws, adhesive, nails, or any other suitable fastener(s).

The first mount may comprise a housing having a rotating lock disk and openings for a key hole and a lock insert. The rotating lock disk may have a track that includes an opening for the lock insert at one end. The second mount may include a base with a permanently attached cord that includes the lock insert at one end. To connect the two mounts with the cord, the lock insert is inserted into the track opening. To lock the device, a key is inserted into the key hole and engages with the rotating lock disk, such that turning the key in a clockwise direction causes the rotating lock disk to rotate. As the rotating lock disk rotates, the track rotates such that a narrow end of the track retains the lock insert, which remains stationary.

To unlock the device, the key is turned in a counterclockwise direction and causes the rotating lock disk to rotate. With the lock insert still stationary, the track on the rotating lock disk rotates and aligns the larger end of the track with the lock insert. In this configuration, the lock insert may be removed from the first mount, disconnecting the first mount and the second mount.

The lock insert may be placed in the track when the rotating lock disk is in a first rotation state. The first rotation state may comprise the rotating lock disk at its maximum counterclockwise extent. In a second rotation state, the rotating lock disk may be at its maximum clockwise extent. In some embodiments, the maximum counterclockwise and clockwise extents may be defined by the length of the track. In other embodiments, they may be defined by blocking features on the rotating lock disk.

In some embodiments, the key may only be inserted in or removed from the key hole and the rotating lock disk when the rotating lock disk is in one of the first and second rotation states. That is, when the rotating lock disk is between the first and second states, the key may not be removed. In some embodiments, a non-removable disk actuator is used to rotate the disk. For example, a knob or lever that may be permanently attached to the first mount and used to rotate the rotating disk.

The insert may comprise a stem and a head, with at least a portion of the stem having a smaller diameter than the head. In one embodiment, the track may be shaped such that the head of the lock insert fits into the enlarged opening of the track, and the remainder of the track narrows around the stem and retains the head. With the lock insert engaged in the track, rotating the rotating lock disk away from the first rotation state prevents the lock insert from being removed from the track.

In one embodiment, the key hole may have a cross shape. In another embodiment, the key hole may have a different polygonal shape, or some other suitable shape. The rotating lock disk may have a depression which the lock insert fits into. Alternatively, the rotating lock disk may comprise a protrusion that engages the lock insert.

In one embodiment, the track has a semi-circular shape on the rotating lock disk. The track may have an enlarged opening at one end, and the remainder of the track is a uniform diameter that is smaller than the enlarged opening. In other embodiments, the track may continuously taper in size, so the track size decreases at a uniform rate from one end to other. In other embodiments, the track may have a circular shape, such the first and second rotation states are separated by almost a full rotation.

Figure 2:
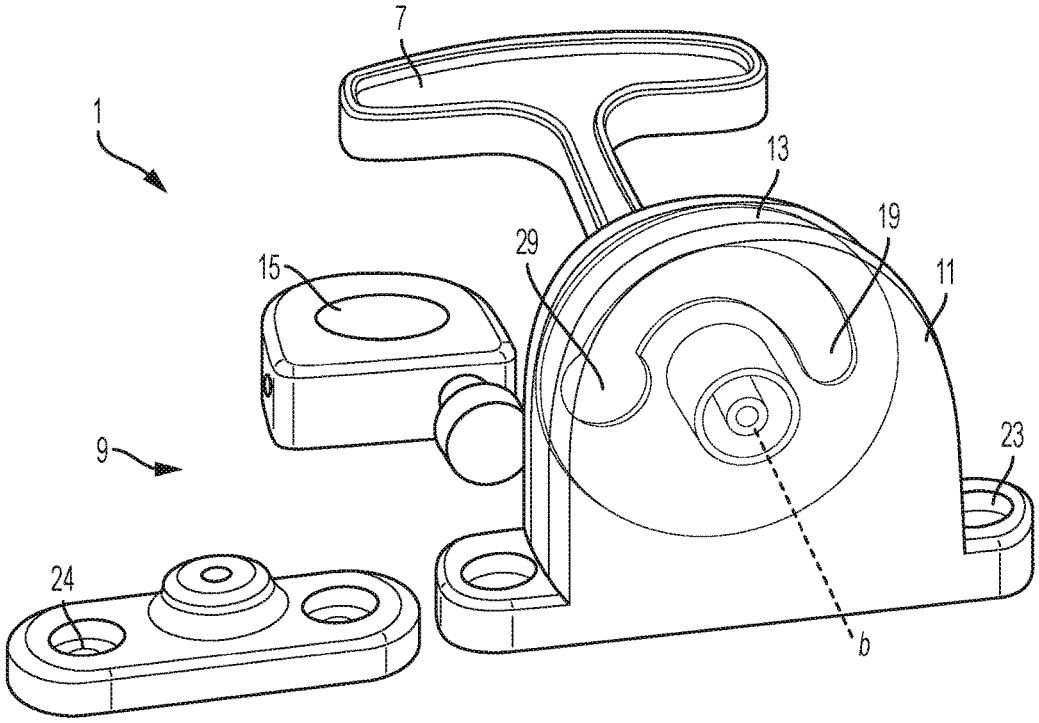
FIG. 2 is a right side, rear perspective view of the embodiment shown in FIG. 1.

Turning now to the figures, FIGS. 1 and 2 show a front and rear view of one embodiment of a window lock. A first mount 11 is attached to a first window component such as a window frame 12, using screw holes 23. A second mount 3 is attached to a second window component such as a sill 14, using screw holes 24. The first and second mounts may be attached to any suitable window components that move relative to each other. In the illustrated embodiment, two screw holes are used to attach each mount 3, 11 to the respective window component, however fewer or more screw holes or other attachment points may be used.

In one embodiment, the first mount 11 includes a key hole 17, a first opening 5, and a rotating lock disk 13. The rotating lock disk 13 is located within the first mount 11, though in other embodiments, the rotating lock disk 13 may be fully or partially exposed. The rotating lock disk 13 includes a track 19 with an insert receptor 29 at one terminus. The key hole 17 may overlap the key receptor 21, and both the key hole 17 and the key receptor 21 are sized and shaped to receive a tip of the key 7. As seen in the embodiment of FIG. 1, the disk includes a height in the vertical direction and a width in the horizontal direction.

The lock insert 15 may have a circular head 16 and the insert receptor 29 may be circular with a diameter that is larger than the width of the remainder of the track 19. The stem 18 of the lock insert 15 may have a smaller diameter than the head 16. In the first rotation state, the first opening 5 and insert receptor 29 are aligned, allowing the head 16 of the lock insert 15 to fit through the insert receptor 29. When the lock insert 15 is fully inserted, the head 16 of the lock insert 15 clears both the first opening 5 and the insert receptor 29, and the track 19 may overlap the stem 18 of the lock insert 15. The lock insert may be inserted in a direction that is perpendicular to the rotating lock disk 13 in some embodiments.

Both the insert receptor 29 and the first opening 5 are sized and shaped to receive the head 16 of the lock insert 15. In the embodiment shown, the first opening 5 and insert receptor 29 are the same size and shape. In other embodiments, the first opening 5 may be larger than and differently shaped from the insert receptor 29. For example, the head 16 of the lock insert 15 may be circular while the first opening is shaped like an octagon that can encompass the lock insert 15, although other configurations are possible. With the insert receptor 29 and first opening 5 aligned, the rotating lock disk 13 is in a first rotation state. In some embodiments, the key hole 17 and key receptor (FIG. 1) may also be aligned in the first rotation state. Rotating the rotating lock disk 13 about an axis b operates the window lock 1.

Figure 3:
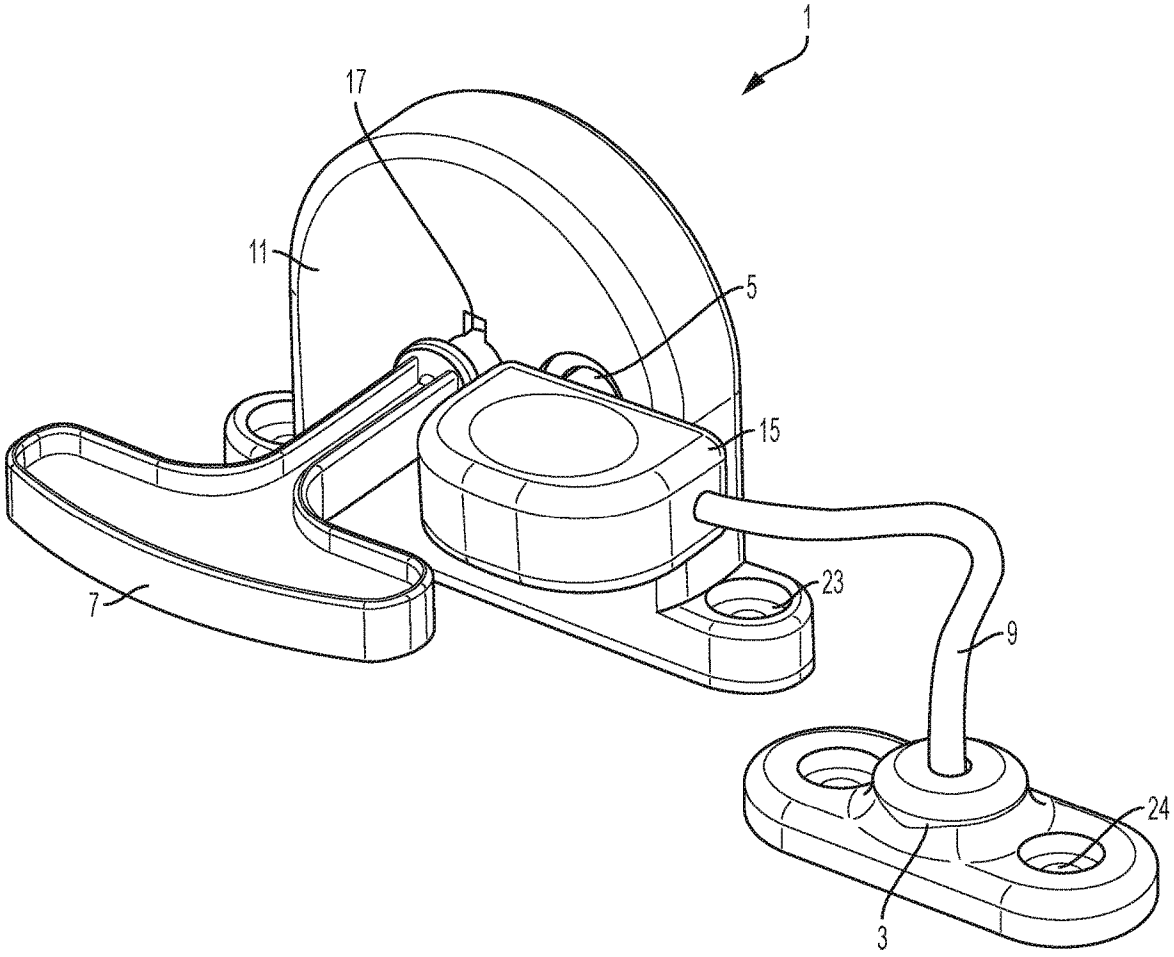
FIG. 3 is a right side, front perspective view of the window lock shown in FIG. 1, with components attached.

FIG. 3 shows a front view of the embodiment of FIGS. 1 and 2, but with the key 7 and lock insert 15 engaged in the first mount 11. With the key hole 7 aligned with the key receptor (FIG. 1) and the insert receptor 29 aligned with the first opening 5, the rotating lock disk is in a first rotation state and the key 7 may be inserted into the rotating lock disk 13. Once inserted fully into the key receptor, the head of the key 7 may completely clear the key hole 17, such that rotation of the key 7 turns the rotating lock disk 13 while the first mount 11 remains stationary.

Figure 4:
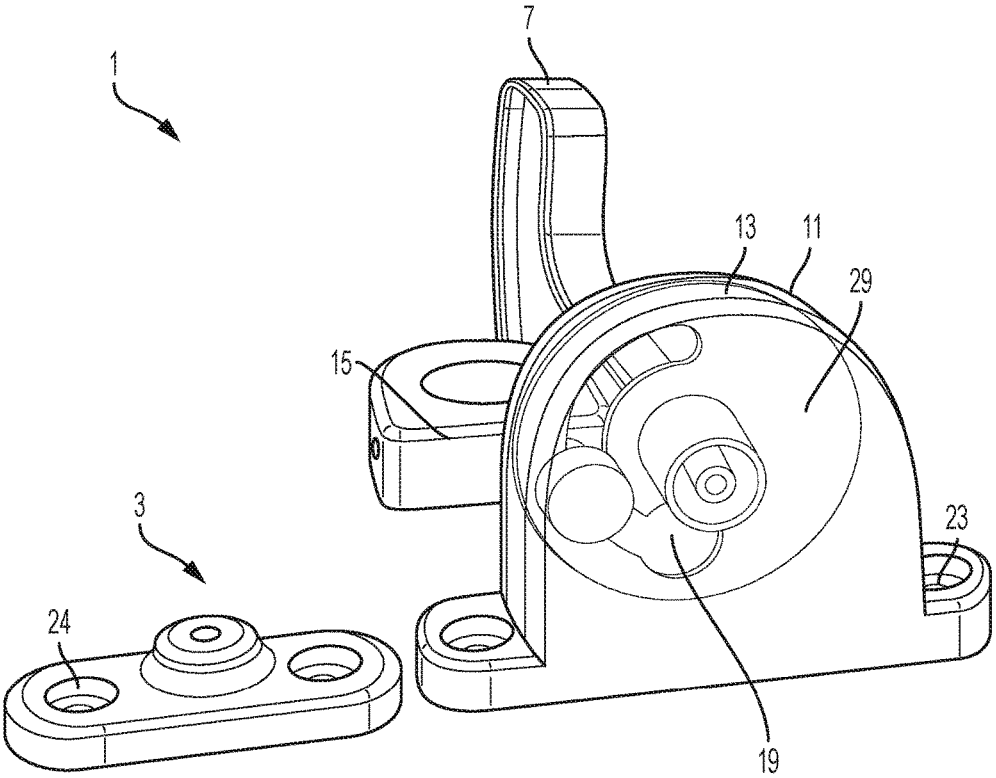
FIG. 4 is a right side, rear perspective view of the window lock shown in FIG. 1, with the window lock partially engaged.

FIG. 4 shows a rear view of the same embodiment, with the rotating lock disk partially rotated. As the key 7 in the key receptor (FIG. 1) rotates the rotating lock disk 13 away from the first rotation state, the key 7 and key receptor become unaligned with the key hole (FIG. 3), and the key hole prevents removal of the key 7. As the rotating lock disk 13 turns from the first rotation state, the track 19 narrows to retain the lock insert 15. In this configuration, the window lock is engaged, because the first mount and second mount are connected and the lock insert 15 cannot be removed. To fully lock the window lock, the key 7 rotates the rotating lock disk 13 to a second rotation state, where the lock insert 15 abuts a second terminus of the track. In this state, the lock insert 15 cannot be pulled out perpendicularly away from the mount because the insert head is blocked by edges of the track.

In the embodiment shown, the key receptor (FIG. 1) and key hole 17 align again in the second rotation state, allowing the key 7 to be removed when the window lock is locked. In some embodiments, the second rotation state comprises rotating the rotating lock disk 13 to its furthest extent to fully engage the lock.

Figure 5:
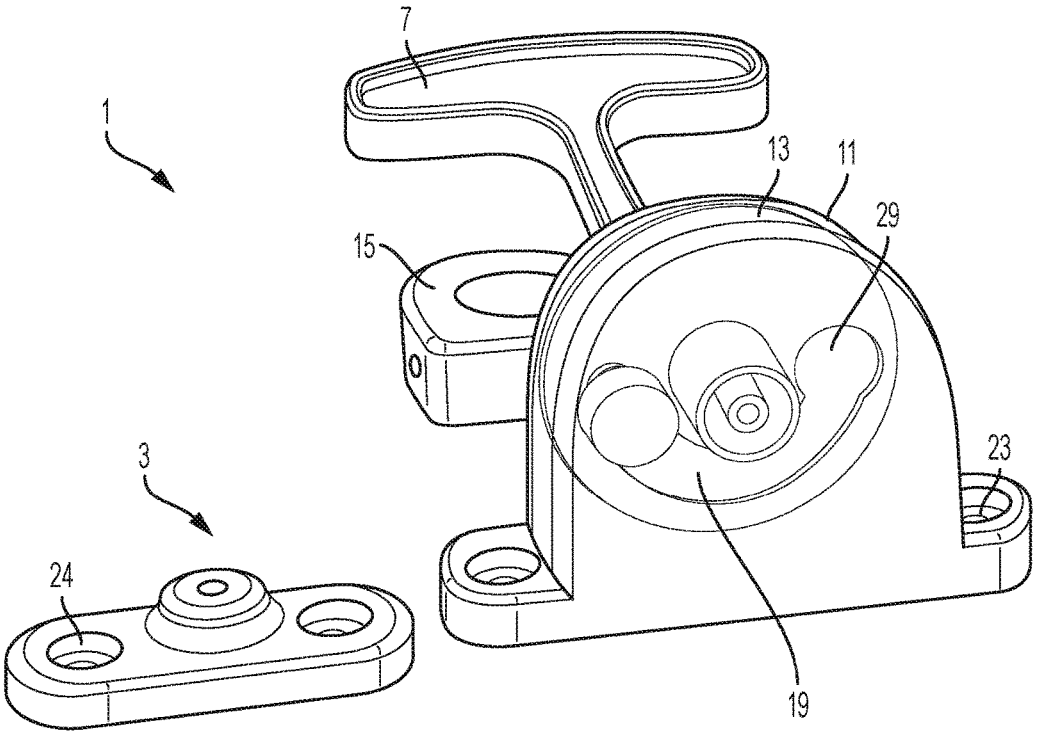
FIG. 5 is a right side, rear perspective view of the window lock shown in FIG. 1 with the window lock fully locked.

FIG. 5 is a rear view of the embodiment shown in FIG. 1 with the lock fully engaged. The rotating lock disk 13 is in the second rotation state and the stem of the lock insert 15 is retained in the narrow portion of the track 19. The key may be removed when the key has been rotated 180° degrees to the second rotation state. In the second rotation state, the window lock is locked and the window portions are connected.

To unlock the window lock, the key 7 is inserted into the key receptor (FIG. 1) and turned 180° degrees clockwise to move the rotating lock disk 13 and the track 19 so that the insert receptor 29 aligns with the first opening 5. Such alignment allows the lock insert 15 to be removed from the insert receptor 29, disconnecting the window portions.

For purposes herein, the term "track" may include channels, slots, or any structure in which the insert can travel. For purposes herein, the term "disk" does not require that the disk be circular, thin, or flat. In some embodiments, the disk may be one or more of circular, thin, and flat.

The use of "including," "comprising," "having," "containing," "involving," and/or variations thereof herein, is meant to encompass the items listed thereafter and equivalents thereof as well as additional items.

The above aspects and embodiments may be employed in any suitable combination, as the present invention is not limited in this respect. It should also be understood that, unless clearly indicated to the contrary, in any methods claimed herein that include more than one step or act, the order of the steps or acts of the method is not necessarily limited to the order in which the steps or acts of the method are recited.

Having thus described several aspects of at least one embodiment of this invention, it is to be appreciated that various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A window lock comprising:

a first mount configured to be attached to a first window component;

a flexible cord attached to the first mount;

a second mount configured to be attached to a second window component, one of the first and second window components being movable relative to the other, the second mount including a rotating lock disk, the disk having a key receptor and a track in a face of the disk, the disk having a thickness that is smaller than both a height and width of the face of the disk;

a lock insert attached to the flexible cord; and a key configured to engage with the key receptor such that rotation of the key rotates the rotating lock disk;

wherein the lock insert is insertable into the track in a direction perpendicular to the lock disk when the disk is at a first rotation state, and the disk has a second rotation state at which removal of the insert from the second mount is prevented.

2. The window lock of claim 1, further comprising the first window component and the second window component.

3. The window lock of claim 1, wherein rotating the key causes the track to move between the first rotation state and the second rotation state.

4. The window lock of claim 1, wherein the first rotation state comprises the rotating lock disk rotated to its maximum clockwise extent, and the second rotation state comprises the rotating lock disk rotated to its maximum counterclockwise extent, and the key is disengagable from the key receptor only when the track is in the first or second rotation state.

5. The window lock of claim 1, wherein the lock insert comprises a stem and a head, the stem having a smaller diameter than the head.

6. The window lock of claim 1, wherein the track has a curved path.

7. The window lock of claim 1, wherein the track has a semi-circular path.

8. The window lock of claim 1, wherein the rotating lock disk is circular.

9. A method of operating a window lock, the window lock comprising a first mount attached to a first window component, a flexible cord attached to the first mount, a second mount attached to a second window component that is movable relative to the first window component, and a lock insert attached to the flexible cord, the method comprising:

inserting the lock insert into a track of a rotating lock disk with the rotating disk being in a first rotation state, the rotating lock disk being attached to the second mount, wherein the track is in a face of the disk, and the disk has a thickness that is smaller than both a height and width of the face of the disk;

inserting a key into a key receptor of the second mount;

turning the key to turn the rotating lock disk from the first rotation state to a second rotation state such that the track of the rotating lock disk prevents the lock insert from being removed from the second mount, the second rotation state being at least 180 degrees from the first rotation state, wherein the lock disk remains within the second mount during the turn from the first rotation state to the second rotation state; and removing the key from the key receptor.

10. The method of claim 9, wherein the first rotation state comprises the rotating lock disk rotated to its maximum clockwise extent, and the second rotation state comprises the rotating lock disk rotated to its maximum counterclockwise extent, and the key is disengagable from the key receptor only when the track is in the first or second rotation state.

11. The method of claim 9, wherein the lock insert comprises a stem and a head, the stem having a smaller diameter than the head.

12. The method of claim 9, wherein the track has a curved path.

13. The method of claim 9, wherein the track has a semi-circular path.

14. The method of claim 9, wherein the rotating lock disk is circular.

15. A window lock comprising:

a first mount configured to be attached to a first window component;

a flexible cord attached to the first mount;

a second mount configured to be attached to a second window component, one of the first and second window components being movable relative to the other, the second mount including a rotating lock disk mounted within the second mount, the rotating lock disk having a thickness that is smaller than a height and a width of the rotating lock disk, the thickness being the dimension that is parallel to a rotation axis of the rotating lock disk;

a lock insert attached to the flexible cord; and a disk actuator which rotates the rotating lock disk from a first rotation state to a second rotation state, wherein the second rotation state is rotated at least a quarter rotation from the first rotation state;

wherein the lock insert is insertable into a track when the disk is at the first rotation state, and when the disk is at the second rotation state, removal of the insert from the second mount is prevented.

16. A window lock as in claim 15, wherein the disk actuator is removable from the second mount.

17. The window lock of claim 15, further comprising the first window component and the second window component, and wherein the first window component comprises a sash and the second window component comprises a sill.

18. The window lock of claim 15, wherein the track has a curved path, and the track prevents removal of the insert from the second mount when the disk is at the second rotation state.

* * * * *